US007758048B1

(12) United States Patent
Crapuchettes et al.

(10) Patent No.: US 7,758,048 B1
(45) Date of Patent: Jul. 20, 2010

(54) MULTIPLAYER GAME WITH STRATEGIC ELEMENT

(75) Inventors: Dominic Crapuchettes, Bethesda, MD (US); Nathanael Breeze Heasley, Brooklyn, NY (US)

(73) Assignee: North Star Games LLC, Bethesda, MD (US)

( * ) Notice: Subject to any disclaimer, the term of this patent is extended or adjusted under 35 U.S.C. 154(b) by 0 days.

(21) Appl. No.: 11/203,306

(22) Filed: Aug. 15, 2005

Related U.S. Application Data

(60) Provisional application No. 60/601,005, filed on Aug. 13, 2004.

(51) Int. Cl.
*A63F 1/00* (2006.01)

(52) U.S. Cl. ..... 273/274; 273/429

(58) Field of Classification Search ..... 273/274, 273/429, 430, 431, 432
See application file for complete search history.

(56) References Cited

U.S. PATENT DOCUMENTS

| | | | | | |
|---|---|---|---|---|---|
| 4,666,161 | A * | 5/1987 | Elesie et al. | ..... | 273/246 |
| 5,746,431 | A * | 5/1998 | McIntyre et al. | ..... | 273/247 |
| 6,070,874 | A * | 6/2000 | Ivers | ..... | 273/292 |
| 6,267,376 | B1 | 7/2001 | Jenkins | | |
| 6,394,899 | B1 * | 5/2002 | Walker | ..... | 463/9 |
| 6,471,207 | B1 | 10/2002 | Schlaifer | | |

* cited by examiner

*Primary Examiner*—William M Pierce
(74) *Attorney, Agent, or Firm*—McNeely & Hare LLP; Kevin J. McNeely

(57) ABSTRACT

A question and answer game includes more than one answer choice to each question and each answer choice has a strategic element with a risk/reward tradeoff.

18 Claims, 5 Drawing Sheets

MULTIPLAYER GAME WITH STRATEGIC ELEMENT

CROSS REFERENCE TO RELATED APPLICATION

This nonprovisional utility patent application claims priority to U.S. provisional patent Ser. No. 60/601,005 filed on Aug. 13, 2004, which is incorporated herein by reference.

FIELD OF THE INVENTION

The present invention relates to games and, more specifically, to multiplayer question and answer games.

BACKGROUND

Question and answer games with multiple players have become very popular. Typically, such games are won by players who have some specific knowledge or skill relating to certain topics, such as, for example, memorization of historical facts or "trivia." Players who lack substantial trivia knowledge relating to a topic are at a disadvantage and may not be motivated to participate. Thus, a need exists for a multiplayer question and answer game that allows players with limited background knowledge on certain trivia topics to win or be competitive at the game.

SUMMARY

The game introduces a strategic element to the act of choosing an answer to a question. In typical question and answer games, an answering player considers only a knowledge element when choosing an answer to a question. The strategic element is achieved by attaching a risk-versus-reward tradeoff (hereinafter, "risk/reward tradeoff") to each answer choice. Consider the following questions:

Question: Which of these musicians has won the most Grammy Awards?

A) Michael Jackson

B) Barbara Streisand

C) Madonna

D) Elvis Presley

In this scenario, the answering player considers only his knowledge in order to answer the question. Let's say that the answering player believes there is a 40% chance that the answer is A, a 20% chance it is B, a 20% chance it is C, and a 20% chance it is D. In this case, he will choose A.

Question: Which of these musicians has won the most Grammy Awards?

A) Michael Jackson—1 point if correct

B) Barbara Streisand—2 points if correct

C) Madonna—3 points if correct

D) Elvis Presley—4 points if correct

In this scenario, the answering player is faced with a risk/reward tradeoff when deciding which answer to choose. As in the previous question, let's say that the answering player believes there is a 40% chance that the answer is A, a 20% chance it is B, a 20% chance it is C, and a 20% chance it is D. In this scenario, the answering player is likely to choose D, even though he thinks A is more likely correct. The reason is that choice D offers him a large enough reward to compensate him for his risk, so he will likely choose D in the hope of gaining 4 points. Therefore, his decision of which answer choice to choose was based upon a strategic element resulting from assigning a risk/reward tradeoff to each answer choice.

Typical question and answer games require an answering player to use only their memory, not to make strategic judgments. However, enjoyment in the world of games is often linked to the number and the importance of the judgments that a player must make. Thus, the game enables players to make judgments that are both more interesting and exciting, leading to question and answer games with more dynamic game play.

In one general aspect, a method of playing a question and answer game includes providing more than one answer choice to each question and adding a strategic element to each answer choice. The selection of an answer choice includes consideration of a risk/reward tradeoff of the strategic element.

Embodiments may include one or more of the following features. For example, adding the strategic element may include assigning a payout of greater than one to at least one answer choice. Assigning the payout may include assigning payouts that are not all identical or assigning higher payouts to more risky answer choices and lower payouts to less risky answer choices.

The method may also include determining the winning answer as the answer choice having a closest numerical value to a correct answer or having a closest numerical value to a correct answer without exceeding the numerical value of the correct answer. The players may be instructed to select one or more answer choice as the potential winning answer.

Players may wager on one or more answer choice as the potential winning answer. Players selecting the winning answer may be awarded in an amount equal to a product of the wager and the payout multiple and players selecting a losing answer may be penalized in the amount of their wager.

The method may also provide that the answer choices are player-generated answer choices.

In another general aspect, a question and answer game includes a playing surface having more than one answer position, each answer position having a strategic element with a risk/reward tradeoff such that selection of an answer choice at a particular answer position includes consideration of a risk/reward tradeoff of the strategic element.

Embodiments may include one or more of the above or following features. For example, the strategic element may include a payout multiple. There also may be seven answer positions arranged to receive each answer choice according to a numerical value from smallest answer choice to largest answer choice. The answer positions may have varying payout multiples, such as, for example, the first and seventh answer positions have a payout multiple of 4 to 1, the second and sixth answer positions have a payout multiple of 3 to 1, the third and fifth answer positions have a payout multiple of 2 to 1, and the fourth answer position has a payout multiple of 1 to 1. In another embodiment, a series of answer positions are configured to receive answer choices according to a numerical order from the smallest answer choice to the largest answer choice.

The game may have player cards configured to receive answer choices and player identifications, such as, for example, a color or a writeable surface. Poker chips may be used to keep track of player wagers and scores.

In a further general aspect, a computer program for processing by a computer to play a question and answer game includes a first code segment to display more than one answer choice to each question, a second code segment to assign a payout to each answer choice such that a more risky answer choice includes a higher payout and a less risky answer choice includes a lower payout, a third code segment to allow players to wager on one or more answer choice as the potential winning answer, a fourth code segment to determine the winning answer, a fifth code segment to award players that select the winning answer an amount equal to a product of the wager and the payout, and a sixth code segment to penalize players that put a wager on a losing answer in an amount of the wager. Embodiments may include one or more of the above features.

DETAILED DESCRIPTION

In a board game utilizing the present invention players don't need to know the exact answer to win. Every player responds to each question and players may wager on any guess that they think is closest to being correct. Players use their knowledge of trivia, the interests of their friends, and/or the odds to help decide how to wager. The closest answer then pays out according to the odds on the playing surface.

Figure 1:
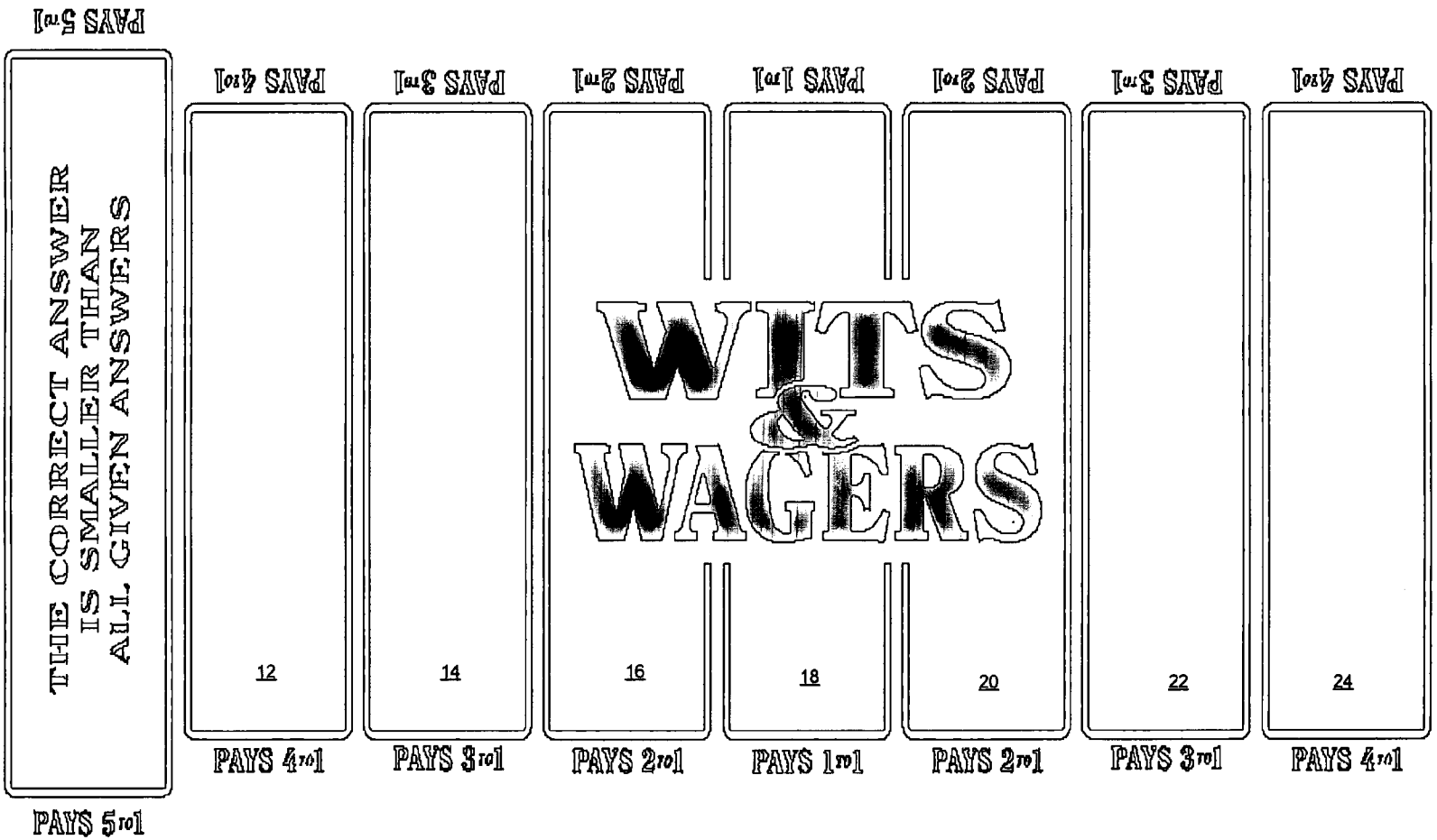
FIGS. 1 and 2 illustrate a playing surface for the game.
Figure 2:
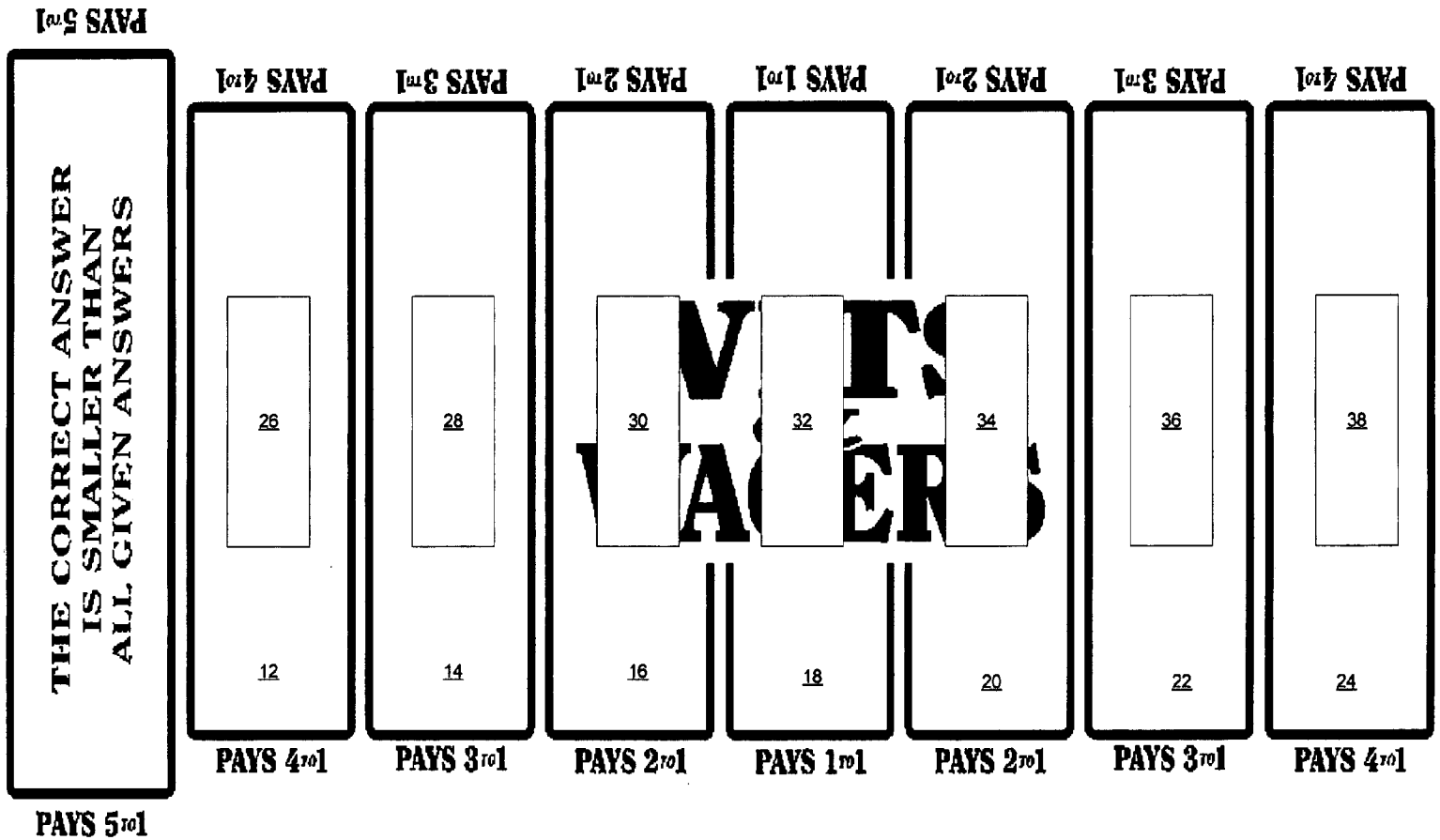

Referring to FIGS. 1 and 2, the playing surface 10 includes first, second, third, fourth, fifth, sixth, and seventh answer positions 12, 14, 16, 18, 20, 22, 24 arranged in a row that have varying assigned odds. Answer positions one 12 and seven 24 have a payout multiple of 4 to 1; answer positions two 14 and six 22 have a payout multiple of 3 to 1; answer positions three 16 and five 20 have a payout multiple of 2 to 1; and answer position four 18 has a payout multiple of 1 to 1.

Answer cards 26, 28, 30, 32, 34, 36, 38 with a dry erasable writing surface can be positioned on the answer positions 12-24. The players write their answers on the answer cards 26-38. All of the answers are numerical, allowing them to be arranged from smallest answer to largest answer from left to right. Players also receive chips (not shown) which are also positioned on the answer positions 12-24 to wager on the potential winning answer.

Figure 3:
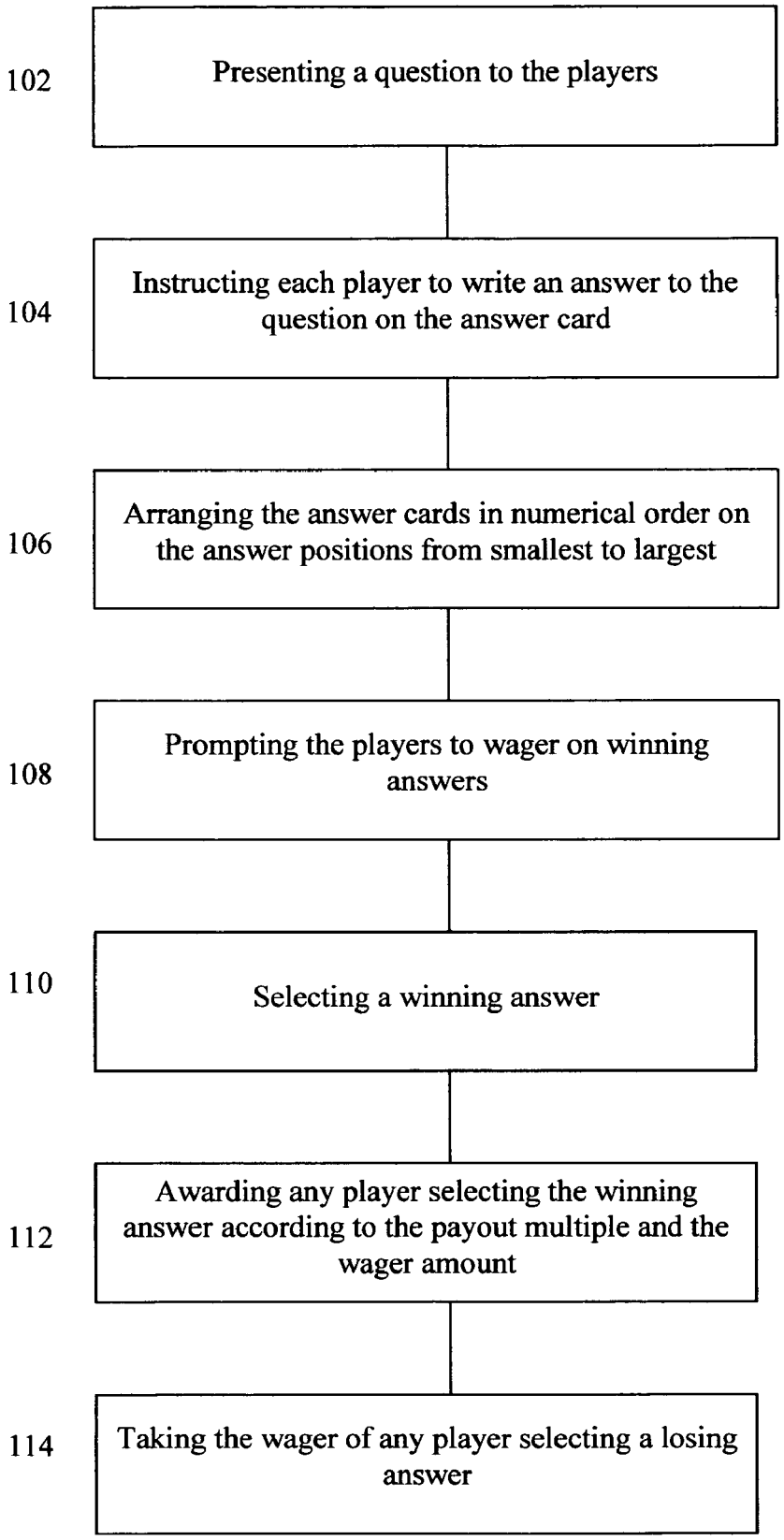
FIG. 3 shows a method of play.

Referring to FIG. 3 a method of play begins by reading a question to the players (step 102). Each player is instructed to write an answer on their playing card (step 104) and then places their playing card on the playing surface.

The answers are arranged from smallest answer to largest answer from left to right on the playing surface answer positions (step 106). The position on the playing surface determines the payout multiple for each answer. Since the median answer is generally most likely to be the winning answer in any group of answers to a random question, the answer occupying the center or fourth answer position 18 has the lowest payout multiple. Similarly, since the "outlying" answers are least likely to be the winning answer, the answers occupying the first and seventh answer positions 12, 24 have the highest payout multiple.

The players are prompted to wager on what they think is the winning answer (step 108). In one embodiment, the players are allowed to wager on one answer choice. In another embodiment, the players are allowed to wager on one or more answer choices. Each player places chips representing a point value on the anticipated winning answer. In placing a wager on an answer choice, the players are allowed to wager on any player answer as the winning answer and do not necessarily have to select the answer that they generated as the winning answer.

The correct answer is revealed and compared to the player answers. In one embodiment, the winning answer is selected as the closest player answer. In another embodiment, the winning answer is the closest player answer that does not exceed the value of the correct answer (step 110).

Players who wagered on the winning answer are awarded in an amount equal to the product of the point value of the wager and the payout multiple (step 112). Players that wagered on a losing answer lose any chips placed on the losing answer (step 114).

The multiplayer game can be implemented by software, such as, for example, by storing a game program on a CD-ROM or on a storage device of a personal computer with a computer display screen or with players at remote terminals over the Internet. Other implementations include television game shows, electronic bartop games, cellular phone games, video games and slot machine games.

Figure 4:
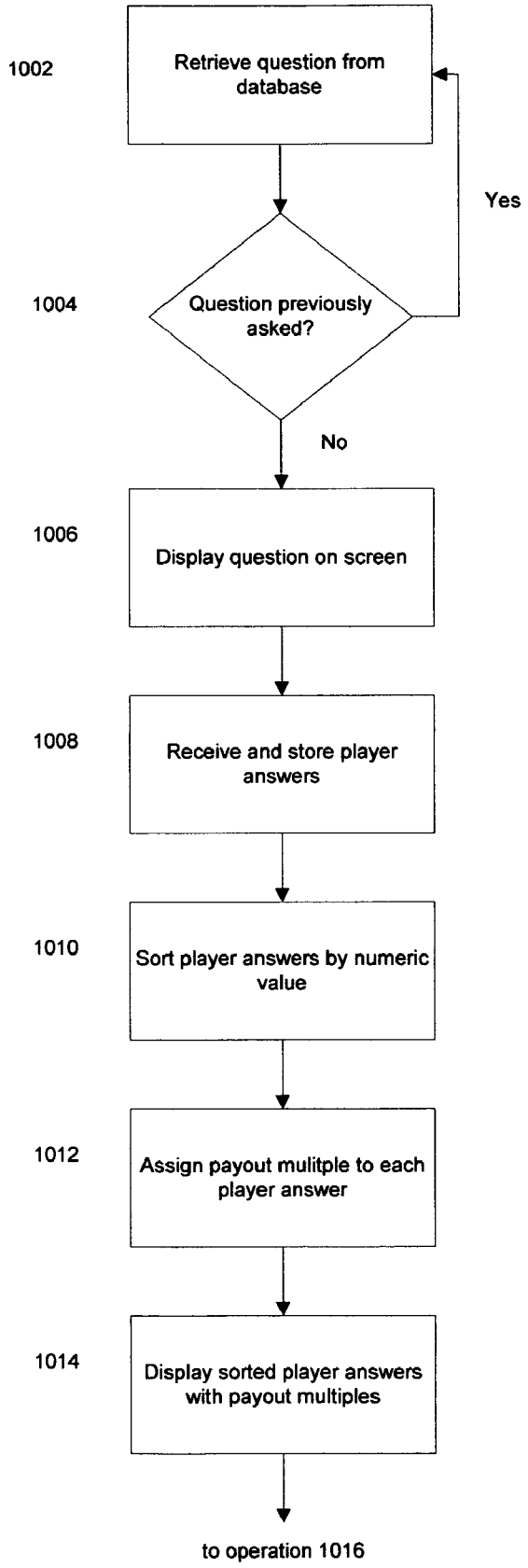
FIGS. 4 and 5 show a game implemented by a software program.
Figure 5:
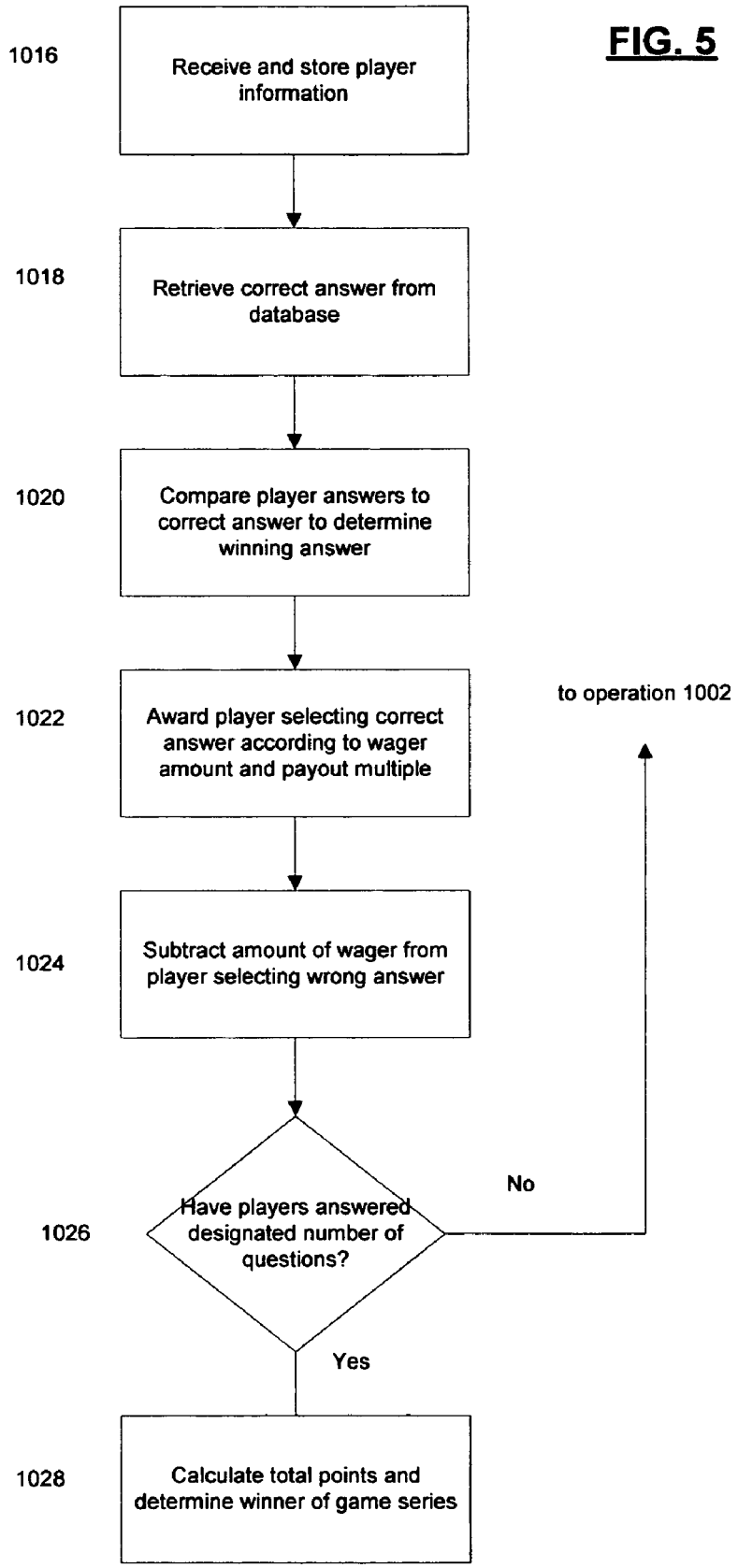

Referring to FIGS. 4 and 5, the software program retrieves a question from a database of questions (operation 1002). If the question has already been asked, another question is retrieved (operation 1004).

The question is displayed on one or more display terminals used by the players (1006). Each player inputs a response to the question using an input device, such as, for example, a keyboard, and the responses are stored (operation 1008). The player responses are sorted or rank ordered according to numerical value (operation 1010).

Each response is assigned a payout multiple according to its numerical position relative to other responses (operation 1012). The median answer is assigned a payout multiple of 1 to 1. Responses above or below the median are assigned higher payout multiples, such as, for example, 2 to 1, 3 to 1, or 4 to 1.

The program displays the sorted player responses with corresponding payout multiples on the display screen (operation 1014). The players can then input their bets or wager on any of the player responses as the winning answer. The program stores the player wager information (operation 1016).

The correct answer is retrieved from the database (operation 1018) and is compared to the player responses to determine the winning answer (operation 1020). In one embodiment, the operation to select the winning answer may include subtracting the player response from the correct answer and designating the lowest numeric value greater than or equal to zero as the winning answer. In another embodiment, the operation to select the winning answer may include subtracting the player response from the correct answer and designating the lowest absolute value as the winning answer.

Players selecting the winning answer receive an award amount by calculation of the product of the wager amount and the payout multiple (operation 1022). The award amount is added to the player's total points for a new point total. Players selecting a losing answer have their wager amount subtracted from their point totals (operation 1024).

Play continues for a series of questions (operation 1026). Once the series of questions is completed, the game ends by determining the winner as the player with the highest total amount of points (operation 1028).

The game may be implemented by hardware, software, or a combination thereof. Changes may be made in the above apparatus and process without departing from the scope of the invention. Thus, all matter contained in the description or shown in the drawings shall be interpreted in an illustrative and not in a limiting sense. Accordingly, other implementations are within the scope of the following claims

We claim:

1. A method of playing a question and answer game, comprising:

providing a playing card for each player and a playing surface having a series of more than one position;

receiving each playing card with an answer choice on the more than one position of the playing surface according to a numerical order from a smallest to a largest answer choice;

assigning a strategic element with a risk-versus-reward tradeoff to each answer choice in response to the position on the playing surface such that selection of an answer choice includes consideration of the risk-versus-reward tradeoff of the strategic element;

prompting one or more players to select an answer choice as a potential winning answer;

determining the winning answer; and awarding an amount according to the strategic element to any player that selects the determined winning answer as the player's selected potential winning answer.

2. The method of claim 1, wherein assigning the strategic element comprises assigning a payout of a multiple greater than one to at least one answer choice.

3. The method of claim 2, wherein assigning the payout includes assigning payouts to each answer choice such that the payouts are not all identical.

4. The method of claim 2, wherein assigning the payout includes assigning a payout to each answer choice such that an answer choice with a greater risk of not being determined as the winning answer includes a reward of a higher payout and an answer choice with a lesser risk of not being determined as the winning answer includes a reward of a lower payout.

5. The method of claim 4, wherein determining the risk-versus-reward of an answer choice is accomplished by ordering the answer choices from the smallest numerical value to the largest numerical value.

6. The method of claim 1, further comprising:

determining the winning answer as the answer choice having a closest numerical value to a correct answer.

7. The method of claim 1, further comprising:

determining the winning answer as the answer choice having a closest numerical value to a correct answer without exceeding the numerical value of the correct answer.

8. The method of claim 1, further comprising:

prompting players to select one or more answer choice as the potential winning answer.

9. The method of claim 1, further comprising:

prompting players to put a wager on any of the player's selected one or more answer choice as the potential winning answer.

10. The method of claim 2, wherein assigning the strategic element comprises assigning a payout multiple to more than one answer choice, wherein the payout multiple is one of a higher payout, a lesser payout, and an identical payout for any of the more than one answer choice; the method further comprising:

awarding any player that put a wager on the winning answer an amount equal to a product of the player's wager and the assigned payout multiple of the winning answer.

11. The method of claim 9, further comprising:

penalizing any player that put a wager on a losing answer an amount equal to the player's respective wager.

12. The method of claim 1, wherein providing more than one answer choice comprises providing more than one player-generated answer choice.

13. A question and answer game, comprising:

more than one player card having an erasable writing surface to indicate an answer choice of a player;

a playing surface having a series of more than one answer position to receive a player card arranged according to a numerical order from a smallest to a largest answer choice;

wager tokens positioned at one or more answer position for each player to indicate a winning answer;

wherein each answer position includes a strategic element with a risk-versus-reward tradeoff such that selection of an answer choice at a particular answer position includes consideration of the risk-versus-reward tradeoff.

14. The game of claim 13, wherein the more than one answer position comprises a first answer position, a second answer position, a third answer position, a fourth answer position, a fifth answer position, a sixth answer position, and a seventh answer position.

15. The game of claim 14, wherein:

the first answer position and seventh answer position have a payout multiple of 4 to 1;

the second answer position and the sixth answer position have a payout multiple of 3 to 1;

the third answer position and the fifth answer position have a payout multiple of 2 to 1; and the fourth answer position has a payout multiple of 1 to 1.

16. The game of claim 13, wherein:

more than one player card includes a player identification.

17. The game of claim 13, wherein:

the wager tokens comprise poker chips to keep track of player wagers and scores.

18. A computer readable medium having embodied thereon a computer program for processing by a computer to play a question and answer game, the computer program comprising:

a first code segment to provide an image of a playing surface with more than one answer position on a display terminal;

a second code segment to prompt each player to input a response to a question with an input device;

a third code segment to sort each response by numerical order;

a fourth code segment to assign a payout to each-response based on the numerical order such that a response of a greater risk of not winning includes a reward of a higher payout and a response of a lesser risk of not winning includes a reward of a lower payout;

a fifth code segment to display each response with the assigned payout on the playing surface;

a sixth code segment to prompt players to wager on one or more answer choice as a potential winning answer;

a seventh code segment to determine a winning answer;

an eighth code segment to award each player that selects the winning answer as the player's potential winning answer an amount equal to a product of the player's respective wager and the assigned respective payout for the response containing the winning answer; and a ninth code segment to penalize each player that put a wager on a losing answer an amount equal to the player's respective wager.

* * * * *